US005424754A

United States Patent [19]

Bar et al.

[11] Patent Number: 5,424,754

[45] Date of Patent: Jun. 13, 1995

[54] ANIMATED WINDOWS WITH MULTI-CHOICE VARIANTS AND ANALOG CONTROLS

[75] Inventors: Abraham Bar, Palo Alto; Emanuel Menczer, Sunnyvale; Raphael Holtzman, San Bruno; Efraim Arazi, San Francisco, all of Calif.

[73] Assignee: Electronics for Imaging, Inc., Del.

[21] Appl. No.: 100,065

[22] Filed: Jul. 29, 1993

Related U.S. Application Data

[63] Continuation of Ser. No. 769,632, Sep. 30, 1991, abandoned.

[51] Int. Cl.[6] ..... G09G 1/28

[52] U.S. Cl. ..... 345/150; 345/119; 395/129; 395/153

[58] Field of Search ..... 395/129, 131, 132, 153, 395/157; 345/119, 120, 150

[56] References Cited

U.S. PATENT DOCUMENTS

| | | | |
|---|---|---|---|
| 4,694,286 | 9/1987 | Bergstedt | 340/703 |
| 4,805,132 | 2/1989 | Okamoto et al. | 340/721 X |
| 4,808,989 | 2/1989 | Tabata et al. | 340/703 X |
| 4,823,303 | 4/1989 | Terasawa | 395/157 X |
| 4,829,294 | 5/1989 | Iwami et al. | 395/157 X |
| 4,831,586 | 5/1989 | Dono | 395/157 |
| 4,974,196 | 11/1990 | Iwami et al. | 395/157 |
| 4,994,989 | 2/1991 | Usami et al. | 395/131 X |
| 5,040,131 | 8/1991 | Torres | 395/157 X |
| 5,057,825 | 10/1991 | Fujii | 395/157 X |

OTHER PUBLICATIONS

*Image Composition via Lookup Table Manipulation*, James D. Foley and Won Chui Kim, George Washington University, pp. 26–35.

*IEEE Computer Graphics and applications*, vol. 4 No. 7 (ISSN 0272-1716), Jul. 1984, p. 3 and pp. 47–51.

*Primary Examiner*—Ulysses Weldon

*Attorney, Agent, or Firm*—Blakely, Sokoloff, Taylor & Zafman

[57] ABSTRACT

A method and apparatus for color processing of an image displayed on a display device of a computer controlled display system. The method comprises storing the first image and a second image in a first memory; displaying the first image on the display device; displaying the second image on the display device; storing a first color information for the first image in a second memory; storing a second color information for the second image in a third memory; modifying the display of the first image by storing a third color information into the second memory. An example of an apparatus for performing this method includes a frame buffer for storing the first and second image in a computer controlled display device with a processor for controlling the display device. The apparatus further includes a memory for storing the color information, such as a video look-up table. The invention provides a way for modifying the display of one image displayed on a display device without modifying the other image on a display device and without modifying the data in the frame buffer for either image. The invention further provides a plurality of variants of the first image which may be selected to thereby modify the display of the first image according to the variant which was selected. The invention also provides analog controls which are linked to the variants for modifying the first image.

65 Claims, 9 Drawing Sheets

| RED 1ST ROW PIXELS | RED LUT OUTPUT | | | RED VLUT OUTPUT f(x) = x+1 | | | RED DISPLAY OUTPUT | | |
|---|---|---|---|---|---|---|---|---|---|
| | IU | $I_{V3}$ (-20%) | $I_{V4}$ (+20%) | C | $C_{V3}$ | $C_{V4}$ | D | $D_{V3}$ | $D_{V4}$ |
| 10 | 10 | 8 | 12 | 11 | 9 | 13 | 11 | 9 | 13 |
| 15 | 15 | 13 | 17 | 16 | 14 | 18 | 16 | 14 | 18 |
| 20 | 20 | 16 | 24 | 21 | 17 | 25 | 21 | 17 | 25 |
| 25 | 25 | 20 | 30 | 26 | 21 | 31 | 26 | 21 | 31 |
| 30 | 30 | 24 | 36 | 31 | 25 | 37 | 31 | 25 | 37 |

FIGURE 7

ANIMATED WINDOWS WITH MULTI-CHOICE VARIANTS AND ANALOG CONTROLS

This is a continuation of application Ser. No. 07/769,632, filed Sep. 30, 1991, now abandoned.

FIELD OF THE INVENTION

The present invention relates to methods and apparatus for displaying images on a display device and for interactively processing images and displaying the results of processing on a display device.

BACKGROUND OF THE INVENTION

Computer controlled display devices have become very useful for displaying information to the user. The information displayed to the user can take many forms. For example, it may be useful to display information in terms of alpha numerical characters to form text, or in terms of line art graphics (also called flat tone graphics), or in terms of continuous-tone imagery, consisting of both natural scenes and/or synthetically generated scenes. Such displays typically use color to increase the amount of information presented to the user. In addition, the displays can be arranged to have different formats and parts. For example, parts of the display may take the form of windows in which an image can be displayed.

It is often desired to manipulate parts of the display and show the results of such manipulation as close as possible to instantaneously on the display. For example, it is often desired to manipulate attributes such as contrast, brightness and color cast of a natural scene displayed on part of the display, and to show the results of such manipulation on the display during the manipulation as an aid to the user.

Unfortunately, the ability to display information in multiple formats on a display device and to interactively manipulate parts of the display and show the results on the same or other parts of the display come at the expense of processing time. The conventional computer-driven display system consists of a large block of memory allocated to store the information for display on the display screen. This memory is broken up into small elements called picture elements (commonly known as pixels), each of which consists of one or more memory bits. For example, the memory allocated to the display device could consist of a two-dimensional array of pixels (e.g., 1,000 pixels by 1,000 pixels) where 24 bits are used to describe the information in each pixel that is, 8 bits are used to describe the amounts of each of red, green and blue, respectively, for that pixel or part of the image. Such a display device would have 3 million bytes of storage space. The memory allocated to the display device is often referred to as a frame buffer. A typical display device is controlled by a video controller which reads out the information in the frame buffer pixel by pixel and converts it to the information needed to drive the physical display. For example, in a cathode ray tube (CRT) display this information is used to drive the red, green, and blue guns of the CRT. Often, a video look-up table (VLUT) exists in a memory device between the frame buffer and the display itself to enable altering of the color information stored in the frame buffer prior to driving the actual display to form a visual image to the user. In some implementations, the RAM of the frame buffer constitutes part of the RAM of the associated computer system.

If the information that forms the image is processed or modified in some manner, displaying the results of such modification or processing involves writing to at least that part of the frame buffer. A disadvantage of this is that it may take some time, given the amount of information involved. For example, to modify a 500 pixel by 500 pixel window of the original 1,000 pixel by 1,000 pixel display involves modifying and rewriting 750,000 bytes when 24 bits per pixel are used.

Some image manipulations or image processing functions are known in the art as point processes. These involve changing the color information at each pixel according to some function of only that pixel. That is, the resulting new color information for that pixel depends only on the original color information of that pixel and on the mathematical function preformed. Examples of point processing include contrast changes, brightness changes, contrast stretching, color cast changes, shadow changes, highlight changes, and mid-tone contrast changes. Image processing which performs functions such as sharpening and blurring, on the other hand, are spatial processes whereby the information at a particular pixel depends not only on the original information in that pixel and on the particular mathematical functions performed, but also on the original information in some neighboring pixels. A feature of point processes is that they can be performed either by mathematical computation or by pre computing the results for all possible inputs and then building a look-up table for that particular function. Using a look-up table is usually a faster operation than calculating the necessary results for each pixel.

Whenever point processes are needed to be performed, a prior art method of overcoming the slowness of needing to rewrite the frame buffer with the results of processing is to load a new video look-up table which combines the original look-up table and the look-up table needed to perform the mathematical function. Such a prior art method is described for example in "Image Composition via Look-up Table Manipulation," by James D. Foley and Won Chul Kim, IEEE Computer Graphics and Applications, November, 1987, pages 26–35. A disadvantage of this prior art scheme is that the processing would be carried out on all pixels in the whole frame buffer whereas it is often desired to perform processing on one geometrically constrained part (e.g. a window region) of the display only without effecting other parts of the display. Therefore, even with this prior art scheme, performing processing on only a part of a display, for example one window, still requires rewriting those memory elements in the frame buffer corresponding to that geometric part of the display. An additional disadvantage of having to rewrite part of the frame buffer is that while these changes are occurring, the user is presented with a continually changing displayed area. This is because parts of the image stored in the frame buffer are being updated and displayed before other parts of the image can be updated and displayed.

For interactive processing of displayed information, one can provide manual control tools, which can either exist as separate devices or can be presented graphically on a display. Examples of such controls are for point processes used to change the aesthetic appearance of color images including brightness, contrast, highlight contrast, shadow contrast, mid-tone contrast, white (or light) point, black (or dark) point, and overall color cast. It is desirable for interactive image processing that changing one or more of these controls changes those attributes on the image being displayed to change as rapidly as possible, appearing to be instantaneous.

If a user is less than completely proficient with the intricacies of image attribute alterations, it is desirable to give the user a preview of how changing these attributes would effect the image. U.S. patent application Ser. No. 07/582,054 ("Color Correction System Employing Reference Picture," William F. Schreiber, Efraim Arazi and Abraham Bar, inventors) filed Sep. 14, 1990, describes a method and means for providing several variants of an original image where each variant provides a preview of what would happen if certain processing were applied to an image. Such processing is not restricted to point processes performed on the original image. As an aid for the user who is less than completely proficient with the intricacies of color attribute alterations and of image processing in general, the user may display several variants on part of a display, and choose to perform the processing not by the manual control but by looking at the variant previews and selecting one of those. This method is referred to as multiple choice.

A disadvantage of the prior art is that there is no tie-in between the manual controls and the multiple choice. An operator who uses multiple choice as the method to effect processing because of lack of proficiency in the intricacies of the art does not learn how to affect the processing manually by using the multiple choice and therefore does not become more proficient in time. Also, when manual control or a selection from the multiple choice is used to affect processing of an image, it is necessary to compute new variants to offer to the user for further multiple choice selection. Using traditional methods, it would take much time to compute new variants. This excess of computing time means that the user cannot proficiently learn the effect of manual changes on the image.

The present invention seeks to improve the ability of computer color systems to give rapid feedback to the user from color modifications of an image, whether by using manual colors or by selecting a multiple choice variant of the image. The invention also seeks to provide rapid updating of one part of a screen without updating other parts. It is a further object of the invention to link the multiple-choice variants to the analog controls so that selection of a variant will result in rapid updating of the user image as well as rapid updating of the analog controls to show the user how a selected variant modified the analog controls.

SUMMARY OF THE INVENTION

The present invention provides a method and apparatus useful for the efficient display of images on a computer display screen.

This invention provides a method and apparatus for processing of color images displayed on a display device of a computer controlled display system. Generally, the method comprises storing a first image and a second image in a first memory means; displaying the first image on the display device; displaying the second image on a display device; storing a first color information for the first image in a second memory means, such as a video look-up table; storing a second color information for the second image in a third memory means, such as a video look-up table; modifying the display of the first image by storing a third color information into the second memory means without changing the second color information for the second image in the third memory means. Typically, the second and third memory means comprise a video look-up table which is partitioned into at least two parts, the first of which is for storing color information, such as the first color information and the third color information for the first image. The other part of the video look-up table is for storing color information for the second image which remains static during the modification of the display of the first image. In a particular embodiment, the frame buffer containing both images will have a bit plane layer which selects between the first or third color information for the first image and the second color information for the second image.

In a particular embodiment, the first image represents a user image and the second image represents a reference image, and the user image will be modified typically in color by comparison to the reference image. A bit plane layer of the frame buffer will select between the two parts of a video look-up table such that color information for the first image will be indexed into the portion of the video look-up table containing color information for the user image (which portion of the video look-up table is modified during modification of the first image) while the color values for the reference image are indexed into the portion of the video look-up table which is not modified during the modification of the first (user) image. In this way, the invention provides for the rapid updating of one part of the screen (for the user image) without updating colors for other parts of the screen, including the reference image.

The invention also provides for the display of multiple variants of the user image and for modifying the display of the user image by selecting one of the variance. In addition, the invention provides analog color attribute controls which allow the rapid updating of the display of the user image, again by modifying one portion of the video look-up table while keeping the other portions static. The selection of one of the variant images will also cause the updating of the analog controls on the display of the display device to provide feedback to the user in a manner which teaches the user the affect of selecting the variant images.

BRIEF DESCRIPTION OF THE DRAWINGS

FIG. 7 is a table of color values following a possible user sequence using the method and apparatus of the present invention.

DETAILED DESCRIPTION

The present invention relates to methods and apparatus for describing and manipulating areas in computer display systems. The following detailed description describes the present invention in the preferred embodiment of a digital computer system. The apparatus for performing the methods and operations of the present invention may be a general purpose computer system, or a specialized graphics display system, or other similar device. The processes of the present invention are not inherently limited to any particular computer or other apparatus.

Figure 1:
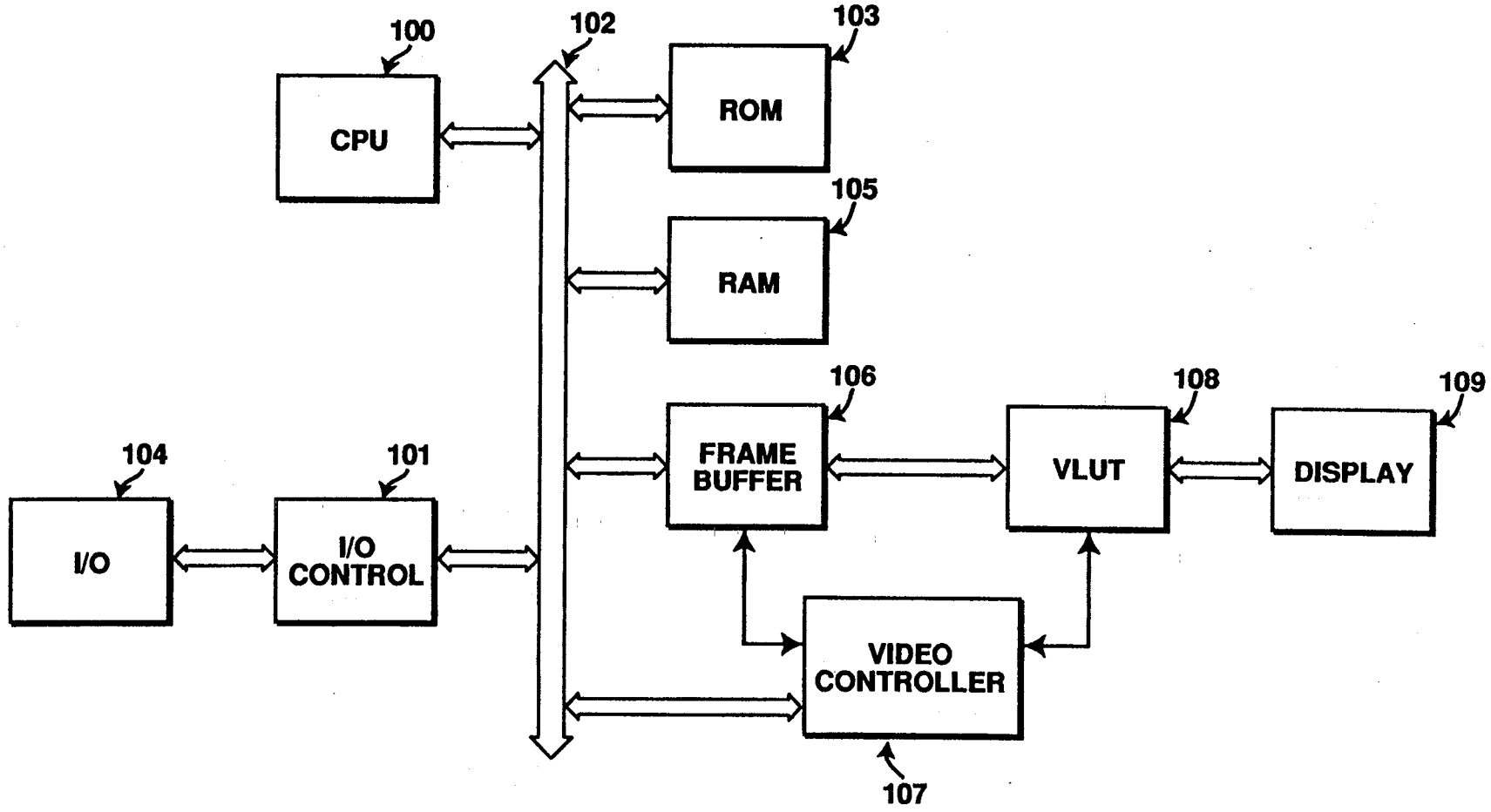
FIG. 1 illustrates a computer incorporating the present invention.

The preferred embodiment of the present invention is implemented on an Apple Macintosh TM computer system manufactured by Apple Computer, Inc. of Cupertino, Calif. As understood by those of ordinary skill in the art, alternative computer systems or other hardware systems may be employed. In general, such systems, as illustrated by FIG. 1, comprise a bus 102 for communicating information, a processor 100 coupled with said bus 102 for processing information, a Random Access Memory (RAM) 105 and a Read Only Memory (ROM) 103 both coupled with said bus 102 for storing information and instructions for said processor 100, an Input/Output (I/O) control 101 coupled with said bus 102 and with an I/O device 104, such as a magnetic disk or a disk drive, for storing information and instructions, a display subsystem comprising a frame buffer 106 coupled to said bus 102 for storing screen display information, a video controller 107 coupled to said frame buffer 106 for controlling output to a Video Look-Up Table (VLUT) 108 and for altering color information of the screen display information stored in said frame buffer 106, and a display device 109 coupled to said VLUT 108 for displaying information, such as a visual image, to the computer user.

The display device 109 may contain a Cathode Ray Tube (CRT) or other suitable display device. Display devices in the preferred embodiment typically display images on a screen using a raster technique, although the invention is not limited to such raster display devices. The raster technique, commonly known in the computer art, is a method whereby the two dimensional display area is divided into small discrete areas called picture elements or pixels. A raster scan line is a horizontal row of pixels on the display screen. In the display device of the present invention each pixel can be displayed as one of a multiple of colors or levels of grey.

In order to display images using the raster technique, the display system sequentially scans the pixels line by line, for example from left to right, and then line after line, for example from top to bottom, across and down the display. In order to determine what each pixel's color should be, video controller 107 accesses frame buffer 106. Frame buffer 106 is a large block of RAM (which may be part of User RAM 105) which defines the manner in which the pixels are to be displayed on the display screen of display 109. In the display device 109, as used in the preferred embodiment of the present invention, 24 bits of memory in frame buffer 106 are used to describe a single pixel on the display screen. The frame buffer 106 is read thereby displaying the desired image. Hence, once frame buffer memory 106 is loaded with the desired image, this image appears on the display device. When a CRT is the display device, the frame buffer memory is read at video rates of several tens of frames per seconds.

Figure 4B:
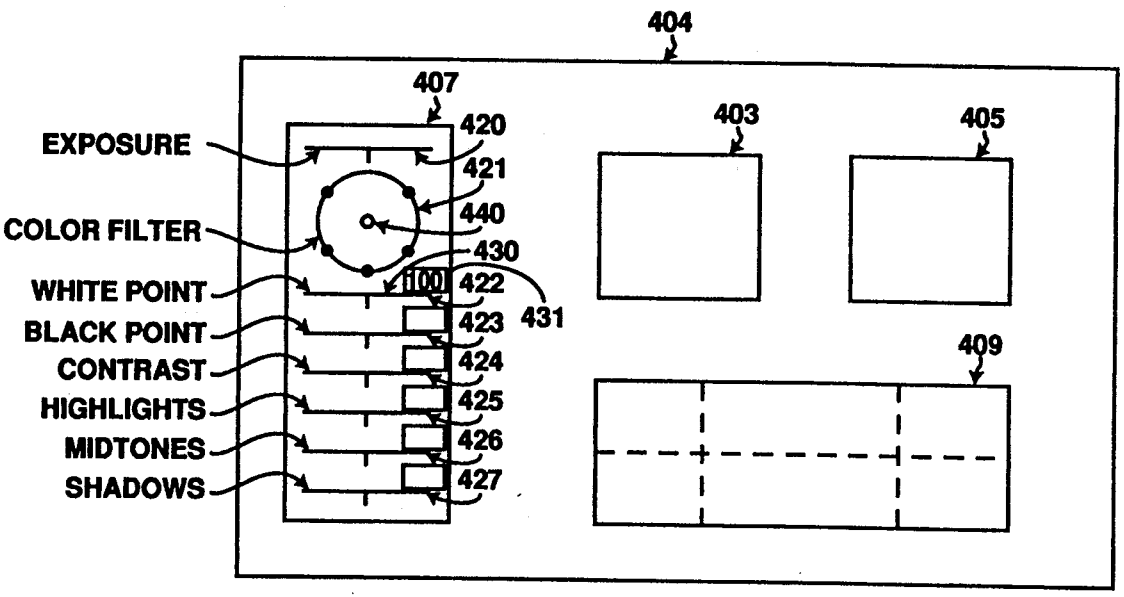
FIG. 4 illustrates some of the screen displays of the present invention.
Figure 4A:
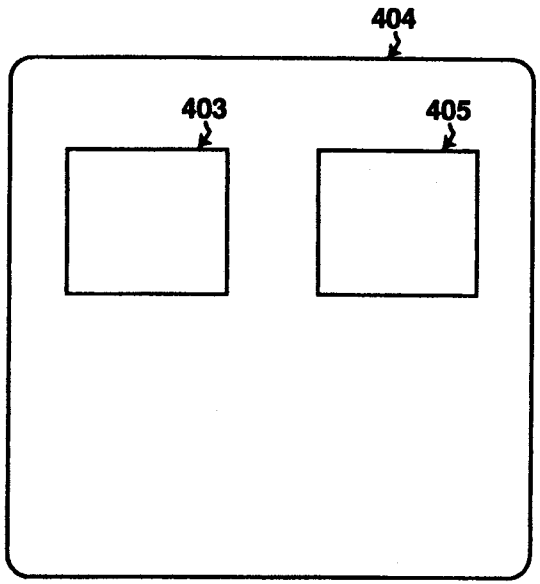

Referring now to FIGS. 4A and 4B, two display screens of the preferred embodiment of the present invention can be seen. FIG. 4A depicts a typical display screen 404 primarily comprised of two regions or portions or windows 403 and 405. Window 403, in the preferred embodiment of the present invention, is used to display a user image which is to be modified in some desired way. Alongside window 403 displaying the user image is window 405 which, in the preferred embodiment of the present invention, displays a reference image. The reference image displayed in window 405 can be used as a comparison vehicle to assist the user in determining whether any color alterations might be desired in the user image displayed in window 403. This side-by-side comparison generally makes the determination of the required color corrections of the user image a simpler process for the user. For example, the reference image may consist of a replica of the user image prior to any modification, thus providing a "before processing" image with which to compare the "after processing" user image. Alternatively, the reference image might consist of an image which has desirable tonal qualities to provide the user with a target image with which to compare the user image.

Referring now to FIG. 4B, display screen 404 shows, in addition to window 403 displaying a user image and window 405 displaying a reference image, analog color controls window 407 and variants window 409.

Analog color controls 407, in the preferred embodiment of the present invention, comprise seven analog attribute controls with an associated numeric value displayed therein, and a color filter wheel. Each of these analog attribute controls 407 affects one of the color attributes or contexts, such as exposure 420, color cast (color filter) 421, white (or light) point 422, and black (or dark) point 423, contrast 424, highlights 425, midtones (or brightness) 426 and shadows 427. Each of the seven analog color attribute controls with an associated value displayed therein 431 includes a slider 430 (e.g., a moveable marker positioned along a visible line) which the user can manipulate (either by direct manipulation via a mouse or by indirect manipulation via menu or keyboard commands) to alter the color attributes of the user image in window 403. Analog color controls 407 also include a color cast wheel also called a color filter wheel depicting the red, green and blue (RGB), CIE-Lab or hue, saturation and value (HSV) color scheme whereby an indicator 440 located within the color cast wheel depicts the relative values of color by which to change the user image. In the preferred embodiment of the present invention, the relative values of red, green and blue with which the user image is changed is depicted by the indicator 440 within the color cast wheel 421. Similarly to the slider controls, the indicator can be manipulated by the user to modify the relative RGB values of the user image in window 403.

Still referring to FIG. 4B, in the preferred embodiment of the present invention, the user may cause to be displayed the variants window 409. Variants window 409 displays six variations of the user image displayed in window 403. That is, when, as a user option, variants window 409 is opened, each of the six variant images is a display of the user image with differing amounts (lesser or greater) of one or more of color attributes such as those provided by the analog controls. In the preferred embodiment of the present invention, one of the color attributes is chosen by the user, with a default attribute provided, and the six variant images displayed are that of the original user image with three greater amounts and three lesser amounts of the chosen color attribute. The step size—the amounts by which the chosen attribute is varied from variant to variant—is selected by the user from a choice, for example, of small, medium and large step size. There is default value of medium size step in the preferred embodiment. The variant images might be of different size to the user image. Alternatively, the variant images might consist of only part of the user image, but with variant amount of the color attribute or attributes. In the preferred embodiment of the present invention, with a "matrix" arrangement of variant images chosen as the display format, the top three variant images across variants window 409 display decreasing color values of the chosen attribute context while the bottom three variant images across variants window 409 display increasing color values of the chosen attribute context. Thus, in the present invention, the user is presented not only with analog color controls 407 which can be used to alter the color attributes of the user image displayed in window 403 but as an option is also shown six variations of decreasing and increasing intensity within the chosen context. This with side by side comparison thus enables the user to have a better understanding of how increasing and/or decreasing the color attributes within the chosen context would affect the user image in display window 403. The variant window 409 may also display, in an alternative embodiment, variant images in more general contexts such as varying green filters, varying skylight filters, different illumination compensation filters or different aesthetic enhancements. These generic options are used to affect changes automatically the same way use of a filter corrects for skylight, etc, in photographic exposure. These filters may be implemented in several well known ways, such as different LUTs (for each RGB channel) for the six variations on a green filter (e.g. least vivid green filter to most vivid green filter).

Figure 2:
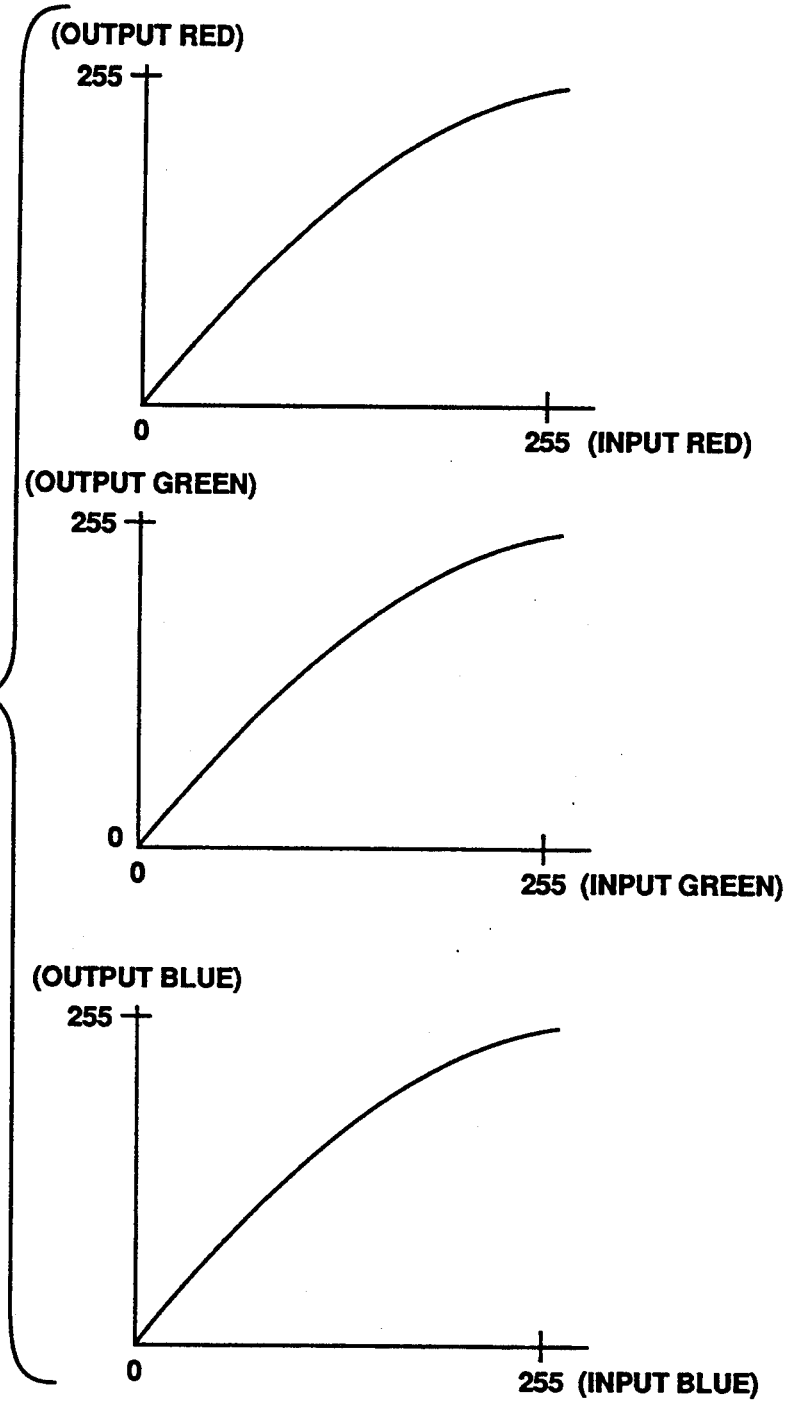
FIG. 2 illustrates some graphs that are used to cause an attribute of a color image to change.

In the preferred embodiment of the present invention, all the changes of color attributes of the user image involve what is known in the art as point processing or point image processing. The color information at each pixel is transformed to new color information at that pixel according to some computational function which uses only the original color information at that pixel to calculate the new color information for that pixel. No other pixel's color information is used. If the color information consists of the red, green and blue values, then point processing can be represented by a three dimensional graph. In the preferred embodiment of the present invention, the point processing is further simplified to three graphs, one each for the red, green, and blue. An example is shown in FIG. 2, where the three graphs for the red, green, and blue data, respectively, are identical. As is known in the art, performing point processing on a color image according to the graphs of FIG. 2 would cause the attribute known as brightness to increase.

In the preferred embodiment of the present invention, each point processing is performed by using three look-up tables (LUTs), one LUT for each of the red, green, and blue data which make up the color information in an image. Details are described below. Alternate embodiments might use other means for performing point processes. Alternate embodiments of the present invention also might use image processing which is not point processing.

In the preferred embodiment of the present invention, The LUT set (of a LUT for each of red, green and blue) is calculated by maintaining a sequence of four parameterized look-up tables in the following order: exposure look-up table $LUT_{exp}$, color cast look-up table $LUT_{col}$, end points (white and black point) look-up table $LUT_{end}$, and gradation (contrast, shadows, midtones and highlights) look-up table $LUT_{grad}$. That is, as an example, to determine the LUT entry for a pixel with red value 5, one looks up entry 5 in the $LUT_{exp}$, and uses $LUT_{exp}(5)$ as the address in $LUT_{col}$, and uses $LUT_{col}(LUT_{exp}(5))$ as the address of $LUT_{end}$ and uses $LUT_{end}(LUT_{col}(LUT_{exp}(5)))$ as the address of $LUT_{grad}$. Then $LUT_{grad}(LUT_{end}(LUT_{col}(LUT_{exp}(5))))$ is the red LUT entry for an address of 5. In the above, only the red channel was shown. Each of the components look-up tables have known parameterized characteristics as described below. When an analog control is moved, one of the component LUTs is changed according to the parameter changed by the slider, and the LUTs thus changed. For example, if one of the end points, say the white point, as changed by increasing it by 10%, $LUT_{end}$ would change (for red green and blue) in the above, so that the LUTs for red green and blue would change. In addition, a color cast change was made, $LUT_{col}$ would also change, and the LUTs therefore would reflect both the end point change and the color cast change so far in the image.

The variant images in variants window 409 are generated when the variants window 409 is opened and a particular attribute context is chosen. Then, a display is generated of the variant images by generating a LUT set (one LUT for each of red, green and blue) for each variant image by varying the parameter value in the component LUTs as described in the paragraph above. Attached to each variant image are the parameters used to generate it.

Furthermore, in the preferred embodiment of the present invention, rather than manipulating a slider within analog color controls 407 the user can select one of the variant images in variants window 409 (either by direct selection via a mouse or by menu or keyboard command) and the color attributes of the user image displayed in window 403 will be updated to match the color attributes of the selected variant image. In this way, the user can see the desired result in the variants window 409, select it, and the displayed user image is thus updated to achieve the selected desired result. This allows the user to quickly preview the change represented by a variant.

In the preferred embodiment of the present invention, when the user chooses one of the variant images, say one with contrast change of +10%, the parameter attached to that choice is used to update the appropriate look-up table used to build the LUTs. In this case, $LUT_{grad}$ would change in exactly the same way as if the user would have modified the manual control for contrast to increase the contrast by 10%.

Still further, as the user image displayed in window 403 is updated and redisplayed, in accordance with the user's manipulation of an analog color slider of window 407 or the selection of a variant image in variant window 409, the six variant images in variant window are also updated and the position of the pointer for each analog slider control is updated. In this way, once the user has selected new color attributes for the user image displayed in window 403, the displayed variant images in variants window 409 again show three decreasing variations and three increasing color attribute variations of the user image within the chosen attribute context.

When the user chooses the "generic variants" windows, each variant, rather than having one parameter change between each variant, has several parameters change in order to generate the "generic options."

Please note that altering the color attributes of the user image could have been accomplished in the prior art by merely altering the indexed color values in the VLUT. However, this would also alter any pixel whose stored color data indexed those changed color values in the VLUT. Thus, the reference image might also be changed. And altering the reference image displayed in window 405 would defeat the purpose of the reference image, that is, to provide a benchmark image against which the user image displayed in window 403 may be compared. The present invention, however, avoids this problem. In the preferred embodiment of the present invention, in order to avoid affecting the color attributes of the reference image displayed in window 405, both the frame buffer and the VLUT are segregated into separate virtual frame buffers and virtual VLUTs.

Figure 3:
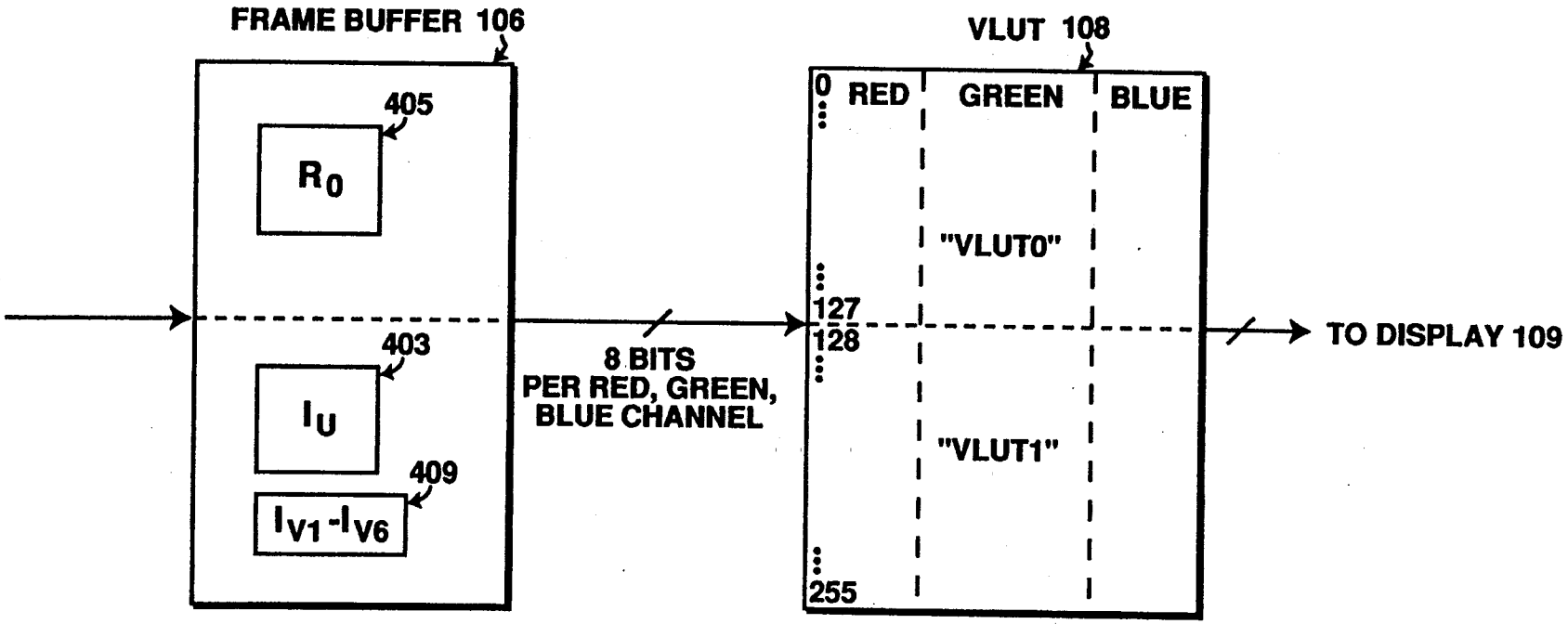
FIG. 3 illustrates the Frame Buffer and Video Look-Up Table (VLUT) of the present invention.

Referring now to FIG. 3, frame buffer 106 is shown divided into two virtual frame buffer windows, one for the reference image displayed in window 405, and one for the user image displayed in window 403 and the variant images displayed in variants window 409. FIG. 3 also shows the VLUT set 108 divided into two virtual VLUT sets, again, one virtual VLUT set for the reference image and one virtual VLUT set for both the user image and the variant images. Each (virtual) VLUT set consists of three VLUTs, one for each of red, green and blue data.

In the preferred embodiment of the present invention, the output of frame buffer 106 is a 24-bit address or index to VLUT 108, 8-bits for each of red, green and blue. Experiments were performed using several human viewers and it was determined that images displayed on the screen with only seven bits for each of red, green and blue are indistinguishable on the display from images with only 8-bits for each of red, green and blue. Therefore, in the preferred embodiment of the present invention, the high order bit of the 8 bit-index to each VLUT in VLUT set 108 is not used to address a specific location in the VLUTs 108 but, rather, is used as a selector between the first virtual VLUT set and the second virtual VLUT set within VLUT set 108. In this way, if for each color, the address/index output from frame buffer 106 is in the range of 0–127 then the first virtual VLUT set is indexed into, and conversely if the address/index output from frame buffer 106 is in the range of 128–255 then the second virtual VLUT set is indexed into. Of course, VLUT set 108 could be divided into multiple virtual VLUT sets in a number of different ways (e.g., odd vs. even addresses) and could even be further broken down into more than two virtual VLUT sets (e.g., four virtual VLUT sets with addresses ranges of 0–63, 64–127, 128–195, and 196–255) while still operating within the spirit of the present invention.

In this way, as will be further explained below, when the user wishes to alter the color attributes of the displayed user image in window 403, it is only the second virtual VLUT set which is altered. And, importantly, the reference image displayed in window 405 indexes the first virtual VLUT set and therefore sees no change in color attributes and thus remains static as its color attributes do not change.

Please note that each virtual VLUT set within VLUT set 108 consists of three VLUTs, one for each of the red, green and blue data in the preferred embodiment of the present invention. In an alternate embodiment of the present invention, only monochrome images might be displayed so that each VLUT set might consist of only one VLUT. In this case, the images would be displayed as monochrome (grey-scale) images.

Figure 5:
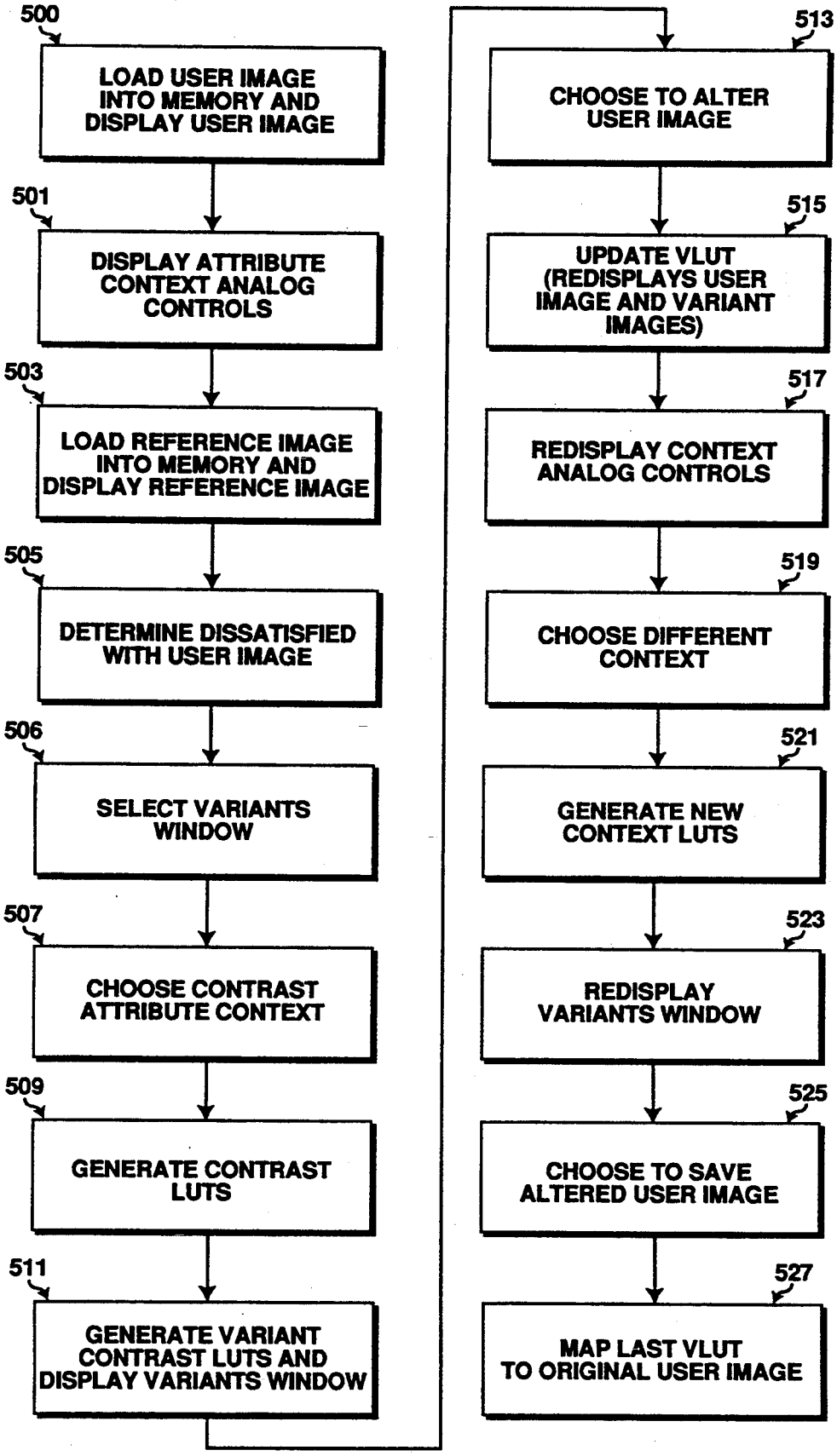
FIG. 5 illustrates a possible sequence of steps when using the present invention.

Referring now to FIG. 5, a typical user sequence in accordance with the preferred embodiment of the present invention is shown. The user would typically begin 500 by loading a user image into memory (RAM) and displaying that user image on the display screen. Note that the details of the data in the user image indexing a LUT (to implement point processing) which outputs a color value which is stored in a frame buffer whose output indexes a VLUT which outputs, at video rate, color values which drive the color display are not reviewed again here for reasons of preserving the clarity of the present invention.

Once the user has the user image displayed on the display screen, in step 501 the color attribute context analog controls are displayed on the display screen which thus allows the user to immediately begin altering the color attributes of the user image within the chosen attribute context (which attribute contexts can, of course, be switched between at will, as is explained more fully below).

Next the user would typically, in step 503, load a reference image into memory and display the reference image on the display screen alongside the user image (or anywhere else on the display screen the user wishes to have the reference image displayed). Again, this thus provides the user with a comparison image having either desirable color qualities as a target, or displaying an unmodified ("before") user image.

After the user has examined the user image displayed on the display screen and compared the user image to the reference image also displayed on the display screen, the user might be dissatisfied with the color attributes of the user image. Therefore the user might choose a color attribute context in which to alter the user image in order to make it more satisfactory. If the user chose the contrast attribute, for example, the LUTs (actually the $LUT_{grad}$ set as described above) would be modified according to known contrast characteristics whenever the user begins manipulating the contrast analog color control in an attempt to improve the color qualities of the user image. In this situation, "choosing" a color attribute does not involve any interaction with the computer. Only when the user begins manipulating one or another of the analog color controls are the LUTs used to implement the point processing changes according to the characteristics of the particular attribute being changed.

Of course, if the user is less than completely proficient with the intricacies of color context/attribute alterations, it is very possible that the user may find that the color attributes of the user image have been made worse rather than better by these alterations. Therefore, in order to see how different contrast variations would look, the user might at step 506 choose to open the variants window. At this point, step 507, the user might choose a color attribute context for the variant images or work with the default attribute context. If the user chose (or the default was) the contrast attribute context, for example, this would cause six contrast LUT sets (each set having three LUTs for R, G and B) to be created, one at a time, to generate the variant images. Each of these LUT sets would be generated by a different contrast modification of the $LUT_{grad}$ set in the manner described above. As shown in FIG. 5, the user selects the contrast attribute context in step 507, which causes the temporary creation, one at a time, of six $LUT_{grad}$ for each RGB channel (step 509) and then the creation in step 511 of six different LUTs for each RGB channel for the six variant images. The LUTs of the variant images are not stored. Rather they are used for display purposes only. The parameters used to generate each of the variant images are kept.

Upon viewing the variant images and comparing them to the user image and the reference image, the user might determine that one of the variant images is closer to the desired color qualities than is the displayed user image and therefore the user could choose to alter the user image, step 513, by merely selecting that variant image. Choosing a variant image also causes the six variant images to be updated, as was explained above, and also causes the analog color controls to be updated in order to properly indicate quantitatively the current color attributes of the redisplayed user image.

Updating the variant images and the user image upon choosing a variant image requires, in step 515, changing the LUTs according to the parameters of the particular variant image selected. Once the LUT set is changed, the virtual VLUT indexed by those images is updated, yet the virtual VLUT indexed by the reference image (which is the other part of the VLUT, there being at least two parts of the VLUT which are selected between as explained in conjunction with FIG. 3) is not updated. Note that this is explained more fully below. Once the virtual VLUT is updated, the user image and the variant images are displayed in accordance with the user's selection (step 517). That is, a newly modified user image appears on the display, and different variant images appear on the display. Note that only the relatively small VLUT is updated rather than, as in the prior art, the relevant part of the frame buffer, a much larger amount of memory. This gives the perception of an instantaneous response to the user, as is desirable in interactive image processing.

Then, as might commonly occur, if the user determines that the user image is still not as is desired, the user might, in step 519, choose another color context in which to alter the color attributes of the user image. Choosing another color attribute context, for example, changing from contrast to the midtone attribute context, causes the system of the preferred embodiment of the present invention to generate new attribute context LUTs in step 521 (for each RGB channel, one new context user LUT and six variant LUTs) in the same manner as described above. That is, the component look-up tables ($LUT_{grad}$ again in this case) are changed according to the parameter of the particular variant, and that is used to generate the LUT set to to update the variant in the frame buffer, and thus update the display screen. This causes, in step 523, the variant images to be redisplayed as three decreasing and three increasing color variations based on the newly chosen color attribute context.

When the user chooses the "generic variants" windows, each variant, rather than having one parameter change between each variant, has several parameters change in order to generate the "generic options." Generic options include changing lighting (daylight to fluorescent, etc), changes in quality (skylight filter, etc), and generic color filters.

If the user determines that the color attributes of the user image are satisfactory, the user might, in step 525, choose to save the altered image so as to avoid having to repeat the alteration steps just completed. Saving the altered image is achieved by mapping the last virtual VLUT to the original user image in step 527. This is performed by saving not the original image, but rather the original image with the pixel data run through the last virtual VLUT set.

Referring now to FIG. 7, a typical user sequence of modifying the color values of the user image while in the contrast context will be reviewed. This user sequence will be reviewed by showing representative values of the LUTs, the virtual VLUT and the display screen output and their subsequent changes after user selection of alternate color values. The LUTs are used to implement the image processing function, while the virtual VLUT is part of the video look up table (VLUT). Please note that for reasons of clarity only the red color values of the red, green, and blue color values of the RGB scheme are shown in FIG. 7. However, in actual use, modifying contrast values would affect all three colors, red, green, and blue, of the RGB scheme. Again, for reasons of clarity, only two variant LUTs, and red channels only, are shown. Again, for reasons of clarity, only the results of processing five distinct pixels with red values of 10, 15, 20, 25, and 30, respectively, are shown.

The first column in the table of FIG. 7 depicts five typical but fictitious red color values for each pixel in, as an example, the first row of pixels of the user image stored in and read from the user RAM. These color values are used, as was explained above, to index the contrast LUTs which are depicted in columns 2–4 in the table of FIG. 7. As is shown, the first pixel of the user image, having a red color value of 10, will index the user image $I_U$ contrast LUT shown in column 2 of the table of FIG. 7. The user image $I_U$ contrast LUT, as is shown, outputs a red color value of 10. Similarly, the first pixel of the user image, still having a red color value of 10, will also index the variant image $I_{V3}$ contrast LUT shown in column 3 of the table of FIG. 7. The variant image $I_{V3}$ contrast LUT, as is shown, is for a color attribute (here contrast) of a decrease of 20%, so outputs a red color value of 8 when the input to this LUT is a 10 (thus depicting a color attribute decreased by 20%). Also similarly, the first pixel of the user image, still having a red color value of 10, will also index the variant image $I_{V4}$ contrast LUT shown in column 4 of the table of FIG. 7. The variant image $I_{V4}$ contrast LUT, as is shown, outputs a red color value for an increased color attribute of +20%, so outputs a red color value of 12.

The output color values, depicted in columns 2–4 of the table of FIG. 7, of the different LUTs (where there is at least one LUT for each of the user image and the multiple variant images) are stored in a frame buffer as was more fully explained above. The color values for each of the user image and the variant images stored in the frame buffer are then input to a VLUT, again as was more fully explained above. Each LUT output is thus separately stored in the frame buffer but all of the color values of the user image and the variant images stored in the frame buffer are input to the same virtual VLUT as was explained more fully above.

The VLUT alters the color values output from the frame buffer in order to properly drive the display screen. In the example shown in the table of FIG. 7 for the red channel, the output of the indexed VLUT is a function whereby, as an example for illustrative purposes only, the color values of each input color value are increased by a value of 1. Therefore, the color value of the first pixel in the first row of the user image $I_U$ becomes a red value of 11. Similarly, the color value of the first pixel in the first row of the variant image $I_{V3}$ would become a red value of 9 (shown in the sixth column of FIG. 7) while the color value of the first pixel in the first row of the variant image $I_{V4}$ would become a red value of 13 (shown in the seventh column of FIG. 7).

The eighth column of the table of FIG. 7 depicts the red values, for the first five pixels in the first row of the user image, which the display device sees as an input color value from the VLUT. Note that the input color values to the display device are the same as the output color values from the VLUT as shown in the fifth column of the table of FIG. 7.

As was explained in more detail above, the user may choose to alter the color attributes of the displayed user image. Altering the color attributes of the displayed user image will now be reviewed with respect to the table of FIG. 7 while still working in the contrast attribute context and with respect to the red values only. Furthermore, because any user selected changes would not affect the user image stored in the user RAM, at least not until the user saves the changed image, the values in the user RAM as shown as an example by the first column of the table of FIG. 7 remain constant.

Assuming that the user decided that the variant image $I_{V3}$ appeared to have the more satisfactory contrast color attributes, then the user would likely select that variant image, again either with a mouse selection or a menu or keyboard command. Upon making that selection, rather than altering the LUT values for either the user image or the variant images in column two, three and four of FIG. 7 (which would then require updating the frame buffer and then waiting for the images displayed to slowly be updated on the display device), in the preferred embodiment of the present invention the virtual VLUT indexed by the user image (and the variant images, for that matter) is updated with the color values of the selected variant image $I_{V3}$ contrast LUT (depicted in column three of the table of FIG. 7). The updated virtual VLUT is depicted as column six in the table of FIG. 7 which shows the new VLUT output as a function of the input color attributes of $I_{V3}$ which is further increased by one according to the function of the VLUT. Furthermore, altering the indexed VLUT values which are output to drive the display screen results in the display screen output also being updated. This is depicted in column nine of the table of FIG. 7 which shows the display output having been updated with the color values in accordance with the new VLUT values as depicted in column six of the table of FIG. 7.

In this way, when the display screen is refreshed by reading the frame buffer contents through the VLUT, the VLUT will now output color values based not on the original user image $I_U$ LUT but on the altered color values from the variant image $I_{V3}$ LUT. This is done, in the preferred embodiment of the present invention, because updating/altering the color values in the virtual VLUT can be processed much more quickly than updating the frame buffer in order to accomplish the same result, namely, altering the user image contrast values to match those of the selected variant image. Columns seven and ten of FIG. 7 show the results if the user would have selected variant 4 which uses the red variant LUT $I_{V4}$.

Once the user has selected a variant image in order to update and redisplay the user image, the variant images must also themselves be updated. With the method and apparatus of the present invention, this is automatically achieved by updating the virtual VLUT, as was explained above, which is accessed by those portions of the frame buffer containing the user image and the variant images. In other words, when the virtual VLUT which is accessed by the user image portion of the frame buffer is updated with the new selected color attributes, the same virtual VLUT is still being accessed by the variant images portions of the frame buffer. As such, the variant images become updated along with the user image. Note that this does not require altering the variant images LUTs nor the frame buffer.

Additionally, once the user has selected a variant image in order to update and redisplay the user image, the color analog controls 407 are also altered so as to reflect the new color attributes. In other words, when the user selects one of the variant images to be used as the "model" to update the user image, the appropriate color analog controls also are updated so as to continue to properly represent the current color attributes of the displayed color user image. This appears to the user as if the whole update was done by using the analog control (e.g., the slider) itself rather than by selecting a variant image.

In the preferred embodiment of the present invention, the linkage of the chosen variant with the analog controls is performed as follows. From the user selected step size, the amounts are determined by which one or more of the color attributes differ in the variant images from those in the user image. Once the user selects one of the variants as the choice, this information of the amount of attribute variation is used to change the display of the position of the relevant analog controls. In the example of FIG. 7, if variant LUT $I_{V4}$ is chosen while in the contrast attribute context, the contrast slider and the numerical scale would be moved to reflect an increase of +20%.

Figure 8:
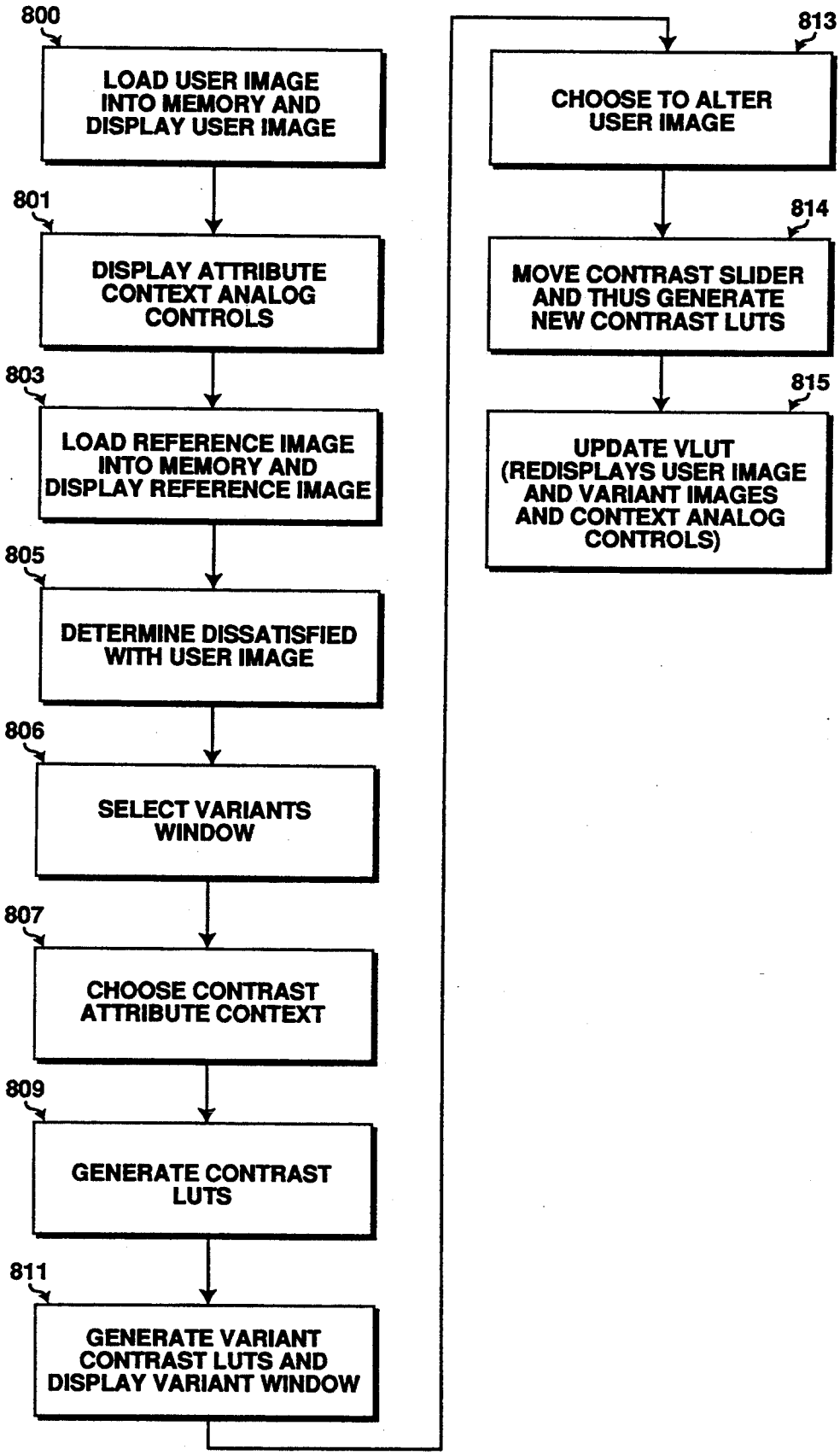
FIG. 8 illustrates another possible sequence of steps when using the present invention.

FIG. 8 shows the sequence in accordance with the preferred embodiment of the present invention if the user had used the analog slider control instead of choosing a variant image to change the appearance of the user image. Steps 800 to 811 inclusive are identical to corresponding steps 500 to 511, inclusive, in FIG. 5. In steps 813 and 814, the user chooses to alter the user image by moving the contrast slider analog control which generates a new LUT set according to the amount by which the slider was moved. This is done as described above by varying $LUT_{grad}$ for each color with the parameter according to the amount by which the slider was changed. The sequence 815, 817, etc, of FIG. 8 from here on is identical to the sequence of steps 515 and 517, etc, shown in FIG. 6 for the case of a variant choice used to modify the user image. Once the virtual VLUT set is updated, new variant images appear which are based on changing the selected attribute context from that of the newly displayed just-modified user image. Note that step 807 of choosing the context affects the variant windows. The sequence from here on is the same no matter which analog control is moved. That is, in the example of FIG. 8 where the contrast attribute context is chosen, if the contrast slider was changed, after the change occurred and the VLUT set was modified, six new variant images would appear with different contrast levels from that of the newly modified (new contrast) user image.

Furthermore, it is not until the user decides to save the altered user image that the user image stored in the user RAM is altered. As was explained above, to save, the image stored in RAM is run through the latest VLUT set, which now consists of the accumulation of all the processing performed on the user image since the last save operation. This data as output from the VLUT set is saved in RAM or elsewhere as the updated image. The VLUT set can now be reset to its original (pre-image-modification) value. An image thus saved can be reloaded into RAM and displayed with a reset ("initial value") VLUT set to display the image with all changes up to the point of the last save operation. The image thus redisplayed will have the same appearance as just before the last save operation.

Figure 6B:
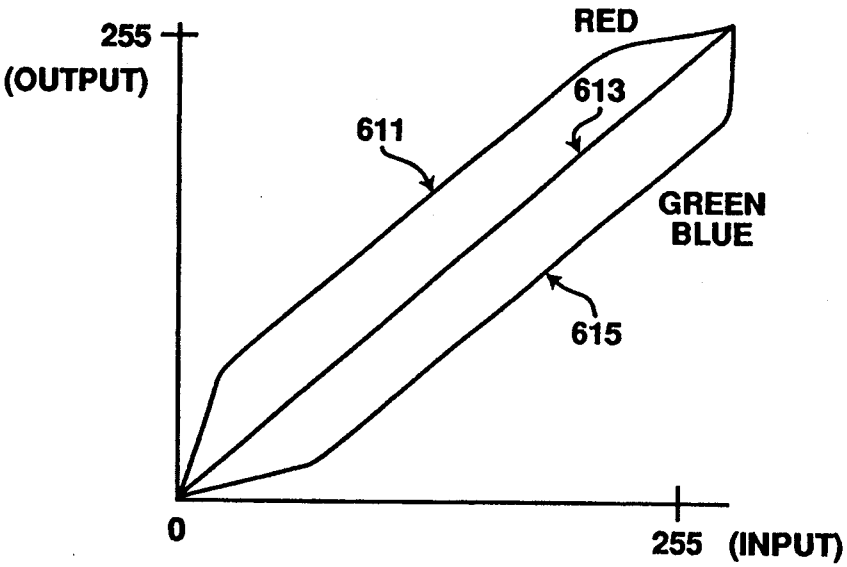
FIGS. 6A, 6B and 6C depict some of the alterations of color contexts available with the present invention.
Figure 6A:
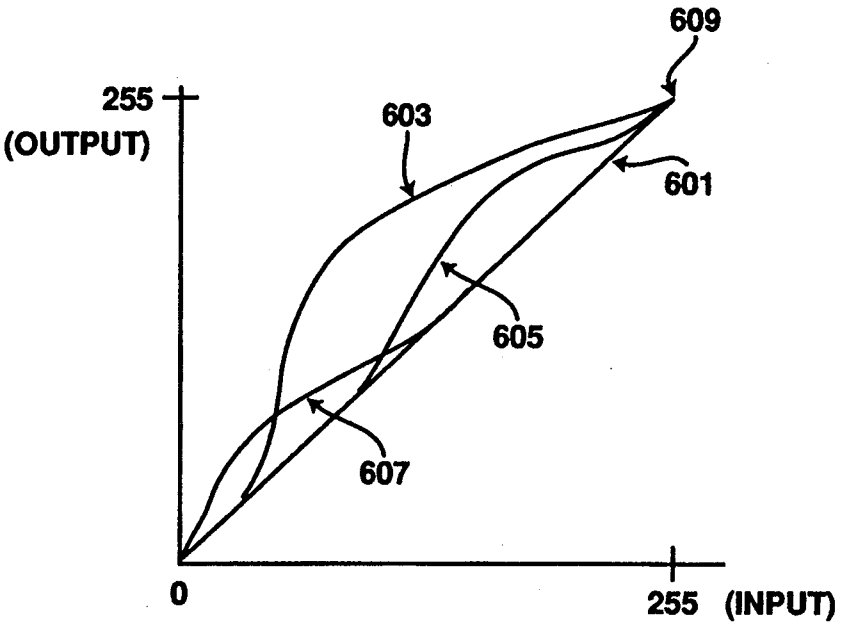
Figure 6C:
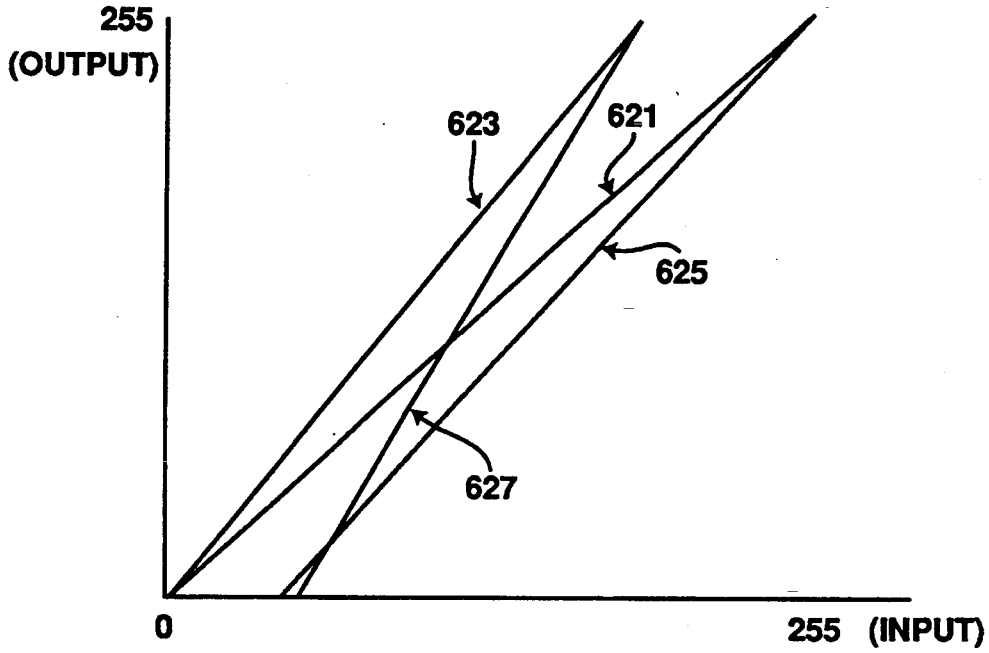

Referring now to FIGS. 6A, 6B and 6C, graphs are shown which depict $LUT_{grad}$, $LUT_{col}$, and $LUT_{end}$ which describe the various color alterations within the various color attribute contexts, which color alterations are displayed by the variant images employed by the preferred embodiment of the present invention. The graphs of FIGS. 6A, 6B and 6C are intended to show the output variant image color value (on the vertical axis) for any given input user image color value (on the horizontal axis) for each of the red, green and blue data sets. Such curves that affect the color attributes such as color cast, brightness (midtones), contrast, etc., are well known in the art and are provided here in approximate form merely for greater clarity of the present invention.

FIG. 6A, depicting $LUT_{grad}$, first shows a first diagonal line 601 which corresponds to a variant image which exactly matches the user image (shown for explanation purposes only, as a variant image, by definition, wouldn't usually match the user image). If the midtones (brightness) context were chosen then moving the midtones slider would cause the input versus output curve to move to line 603. Moving the slider more changes the amplitude of the curve 603. Curve 603 of FIG. 6A shows an increasing color intensity output for a given input color which corresponds to creating a variant image with increased brightness (also called midtones) over the user image. The amount by which each the curved vary are the parameters of $LUT_{grad}$.

FIG. 6C depicts $LUT_{end}$. If the White Point (also called Light Point) attribute context were chosen then diagonal line 621 would move to straight line 623, the amount of movement depending on the amount of white point change selected.

If the Black Point context were chosen then again referring to FIG. 6C, depicting $LUT_{end}$, diagonal line 621 would move to straight line 625, the amount of movement depending on the amount of Black Point change selected. If the White point was previously changed to line 623, then the result of a subsequent black point change would be curve 627. Note again that such changes would be carried out on three curves, one each for red, green, and blue.

If the Highlights context were chosen then the top part only of the input versus output curve $LUT_{grad}$ would move to line 605. Curve 605 of FIG. 6A shows an increasing color intensity output for a given input color which is itself on the upper half of the color range which thus corresponds to creating a variant image with increased color intensity over the user image of the upper range of color intensities only.

If the Shadows context were chosen then the lower part only of the input versus output curve $LUT_{grad}$ would move to line 607. Curve 607 of FIG. 6A shows a decreasing color intensity output for a given input color which is is itself on the lower half of the color range which thus corresponds to creating a variant image with decreased color intensity over the user image of the lower range of color intensities only.

Referring now to FIG. 6B, depicting $LUT_{col}$, if the Color Cast context were chosen then all three curves for each of the three colors red, green and blue, would be utilized, each in a different way, to generate a variant image with a different color cast than the user image. Curve 613 of FIG. 6B is what each of the three curves for the red, green and blue would be for there to be no changes to the image. To cause an increase in overall red cast, the input vs. output curve for red would move approximately to line 611, while those for green and blue would move to 615.

The above description has been on point processing. However this invention is not restricted to point processes but is general to all image processing. The manual (analog) controls might control other non-point image processes such as sharpening and blurring. Using variant images to choose the level or type or amount of processing as an aid to the user and linking the manual (analog) controls to the variants would work identically to the preferred embodiment of the present invention as described above. That is, whenever a variant is selected, new variants are generated and the manual controls are moved to reflect that change, and also whenever a manual control is used to affect a change, new variants are generated and displayed.

Although this invention has been shown in relation to a particular embodiment it should not be considered so limited. Rather, the present invention is only limited by the appended claims.

We claim:

1. In a computer controlled display system, a method for color processing of an image displayed on a display device of said display system, said method comprising:

storing a first image and a second image in a first memory means;

displaying said first image on said display device within a first spatial window;

displaying said second image on said display device within a second spatial window;

storing a first color information for said first image in a second memory means;

storing a second color information for said second image in a third memory means; and modifying the appearance of said first image on said display device by storing a third color information into said second memory means.

2. A method as in claim 1 further comprising displaying a plurality of variants of said first image and modifying the display of said first image by selecting one of said variants to cause said third color information to be stored into said second memory means.

3. A method as in claim 1 further comprising providing a plurality of analog color attribute controls for modifying said first image, wherein the manipulation of one of said analog color attribute controls modifies said first image by storing said third color information into said second memory means.

4. A method as in claim 1 further comprising displaying a plurality of variants of said first image and displaying a plurality of analog color attribute controls for modifying said first image, wherein the display of said first image is modified by storing said third color information by one of (a) manipulating one of said analog controls and (b) selecting one of said variants, and wherein if one of said variants is selected, said first image is modified and the display of an analog control of said plurality of analog colors is modified to correspond to the modification of said first image.

5. A method as in claim 1 wherein said first memory means is a frame buffer for said display device and said modifying the display of said first image is performed without modifying the first image stored in said first memory means.

6. A method as in claim 5 wherein said modifying the display of said first image is performed without modifying the second color information for said second image.

7. A method as in claim 6 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

8. A method as in claim 7 wherein said first image is a user image and said second image is a color reference and wherein said user image is displayed in a first window and said reference image is stored in a second window.

9. A method as in claim 2 wherein said first memory means is a frame buffer for said display device and said modifying the display of said first image is performed without modifying the first image stored in said first memory means.

10. A method as in claim 9 wherein said modifying the display of said first image is performed without modifying the second color information for said second image.

11. A method as in claim 10 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

12. A method as in claim 11 wherein said first image is a user image and said second image is a color reference and wherein said user image is displayed in a first window and said reference image is stored in a second window.

13. A method as in claim 3 wherein said first memory means is a frame buffer for said display device and said modifying the display of said first image is performed without modifying the first image stored in said first memory means.

14. A method as in claim 13 wherein said modifying the display of said first image is performed without modifying the second color information for said second image.

15. A method as in claim 14 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

16. A method as in claim 15 wherein said first image is a user image and said second image is a color reference and wherein said user image is displayed in a first window and said reference image is stored in a second window.

17. A method as in claim 4 wherein said first memory means is a frame buffer for said display device and said modifying the display of said first image is performed without modifying the first image stored in said first memory means.

18. A method as in claim 17 wherein said modifying the display of said first image is performed without modifying the second color information for said second image.

19. A method as in claim 18 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

20. A method as in claim 19 wherein said first image is a user image and said second image is a color reference and wherein said user image is displayed in a first window and said reference image is stored in a second window.

21. A method as in claim 2 wherein said plurality of variants shows a variation of the first image in a generic context.

22. A method as in claim 21 wherein said generic context is a color filter.

23. A method as in claim 22 wherein said variation shows the first image in various degrees of said color filter.

24. A method as in claim 21 wherein said generic context comprises a modification of lighting for the plurality of variants.

25. A method as in claim 24 wherein said modification of lighting comprises one of a modification from daylight lighting to incandescent lighting and a modification from daylight lighting to fluorescent lighting and a modification from incandescent lighting to daylight lighting and a modification from fluorescent lighting to daylight lighting and a modification from fluorescent lighting to incandescent lighting and a modification from incandescent lighting to fluorescent lighting.

26. A method as in claim 21 wherein variants in said generic context requires that several parameters are varied between each variant of said plurality of variants.

27. An apparatus, in a computer controlled display system, for color processing of an image displayed on a display device of said display system, said apparatus comprising:

a means for storing a first image and a second image in a first memory means;

a means for displaying said first image within a first spatial window and said second image within a second spatial window, said means for displaying being coupled to said means for storing said first and second images;

a means for storing a first color information for said first image in a second memory means, said means for storing being coupled to said means for displaying;

a means for storing a second color information for said second image in a third memory means, said means for storing being coupled to said means for displaying; and means for modifying the appearance of said first image on said display device by storing a third color information into said second memory means, said means for modifying being coupled to said second memory means.

28. An apparatus as in claim 27 further comprising a means for displaying a plurality of variants of said first image and a means for modifying the display of said first image by selecting one of said variants to cause said third color information to be stored into said second memory means.

29. An apparatus as in claim 27 further comprising a means for displaying a plurality of analog color attribute controls for modifying said first image, wherein the manipulation of one of said analog color attribute controls modifies said first image by storing said third color information into said second memory means.

30. An apparatus as in claim 27 further comprising a means for displaying a plurality of variants of said first image and a means for displaying a plurality of analog color attribute controls for modifying said first image, and wherein the display of said first image is modified by storing said third color information by one of (a) manipulating one of said analog controls and (b) selecting one of said variants, and wherein if one of said variants is selected, said first image is modified and the display of an analog control of said plurality of analog control is modified to correspond to the modification of said first image.

31. An apparatus as in claim 28 wherein said plurality of variants shows a variation of the first image in a generic context.

32. An apparatus as in claim 31 wherein said generic context is a color filter.

33. An apparatus as in claim 32 wherein said variation shows the first image in various degrees of said color filter.

34. An apparatus as in claim 28 wherein said first memory means is a frame buffer for said display device and wherein said means for modifying modifies the display of said first image without modifying the first image stored in said first memory means.

35. An apparatus as in claim 34 wherein said means for modifying the display of said first image does not modify the second color information for said second image.

36. An apparatus as in claim 35 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

37. An apparatus as in claim 36 wherein said first image is a user image and said second image is a color reference and wherein said user image is displayed in a first window and said reference image is stored in a second window.

38. An apparatus as in claim 24 wherein said first memory means is a frame buffer for said display device and wherein said means for modifying modifies the display of said first image without modifying the first image stored in said first memory means.

39. An apparatus as in claim 38 wherein said means for modifying the display of said first image does not modify the second color information for said second image.

40. An apparatus as in claim 39 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

41. An apparatus as in claim 40 wherein said first image is a user image and said second image is a color reference and wherein said user image is displayed in a first window and said reference image is stored in a second window.

42. An apparatus as in claim 30 wherein said first memory means is a frame buffer for said display device and wherein said means for modifying modifies the display of said first image without modifying the first image stored in said first memory means.

43. An apparatus as in claim 42 wherein said means for modifying the display of said first image does not modify the second color information for said second image.

44. An apparatus as in claim 43 wherein said second memory means and said third memory means comprise at least one video look-up table (VLUT), wherein said first color information is stored in a first part of said VLUT and said second color information is stored in a second part of said VLUT and wherein information from said frame buffer selects between said first part and said second part of said VLUT.

45. An apparatus as in claim 44 wherein said first image is a user image and said second image is a color reference and wherein said user image is displayed in a first window and said reference image is stored in a second window.

46. An apparatus as in claim 31 wherein said generic context comprises a modification of lighting for the plurality of variants.

47. An apparatus as in claim 46 wherein said modification of lighting comprises one of a modification from daylight lighting to incandescent lighting and a modification from daylight lighting to fluorescent lighting and a modification from incandescent lighting to daylight lighting and a modification from fluorescent lighting to daylight lighting and a modification from fluorescent lighting to incandescent lighting and a modification from incandescent lighting to fluorescent lighting.

48. An apparatus as in claim 31 wherein variants in said generic context requires that several parameters are varied between each variant of said plurality of variants.

49. In a computer controlled display system, a method for color processing of an image displayed on a display device of said display system, said method comprising:

displaying a user image on said display device;

displaying a plurality of analog color attribute controls for modifying said user image;

displaying a plurality of variants of said user image; and modifying the display of said user image by one of (a) selecting a particular variant of said plurality of variants or (b) by varying an analog color attribute control of said plurality of analog color attribute controls.

50. A method as in claim 49 further comprising modifying the display of at least one of said analog color attribute controls when one of said plurality of variants is selected.

51. An apparatus in a computer controlled display system for color processing of an image displayed on a display device of said display system, said apparatus comprising:

means for displaying a user image on said display device, said means being coupled to said display device;

means for displaying a plurality of analog color attribute controls for modifying said user image said means being coupled to said display device;

means for displaying a plurality of variants of said user image said means being coupled to said display device; and means for modifying the display of said user image by one of (a) selecting a particular variant of said plurality of variants or (b) by varying an analog color attribute control of said plurality of analog color attribute controls, said means for modifying being coupled to said display device.

52. An apparatus as in claim 51 wherein said means for modifying comprises a means for storing information in a frame buffer which contains a representation of said user image.

53. An apparatus as in claim 52 further comprising means for modifying the display of at least one of said analog color attribute controls when one of said plurality of variants is selected.

54. A method as in claim 49 wherein said plurality of variants shows a variation of the first image in a generic context.

55. A method as in claim 54 wherein said generic context is a color filter.

56. A method as in claim 55 wherein said variation shows the first image in various degrees of said color filter.

57. A method as in claim 54 wherein said generic context comprises a modification of lighting for the plurality of variants.

58. A method as in claim 57 wherein said modification of lighting comprises one of a modification from daylight lighting to incandescent lighting and a modification from daylight lighting to fluorescent lighting and a modification from incandescent lighting to daylight lighting and a modification from fluorescent lighting to daylight lighting and a modification from fluorescent lighting to incandescent lighting and a modification from incandescent lighting to fluorescent lighting.

59. A method as in claim 54 wherein variants in said generic context requires that several parameters are varied between each variant of said plurality of variants.

60. An apparatus as in claim 51 wherein said plurality of variants shows a variation of the first image in a generic context.

61. An apparatus as in claim 60 wherein said generic context is a color filter.

62. An apparatus as in claim 61 wherein said variation shows the first image in various degrees of said color filter.

63. An apparatus as in claim 60 wherein said generic context comprises a modification of lighting for the plurality of variants.

64. An apparatus as in claim 63 wherein said modification of lighting comprises one of a modification from daylight lighting to incandescent lighting and a modification from daylight lighting to fluorescent lighting and a modification from incandescent lighting to daylight lighting and a modification from fluorescent lighting to daylight lighting and a modification from fluorescent lighting to incandescent lighting and a modification from incandescent lighting to fluorescent lighting.

65. An apparatus as in claim 60 wherein variants in said generic context requires that several parameters are varied between each variant of said plurality of variants.

* * * * *